US006860047B1

(12) United States Patent
Rodriguez

(10) Patent No.: US 6,860,047 B1
(45) Date of Patent: Mar. 1, 2005

(54) ILLUMINATED FLAG DECAL

(76) Inventor: Steve Rodriguez, P.O. Box 6146, Corpus Christi, TX (US) 78466-6146

( * ) Notice: Subject to any disclaimer, the term of this patent is extended or adjusted under 35 U.S.C. 154(b) by 0 days.

(21) Appl. No.: 10/636,650

(22) Filed: Aug. 8, 2003

(51) Int. Cl.[7] ..... G09F 13/04; G09F 21/04
(52) U.S. Cl. ..... 40/591; 40/564; 40/597
(58) Field of Search ..... 40/591, 597, 564, 40/716

(56) References Cited

U.S. PATENT DOCUMENTS

| | | | | | |
|---|---|---|---|---|---|
| 1,856,519 | A | * | 5/1932 | Arthur | 40/564 |
| 3,004,359 | A | | 10/1961 | Pisciotta | |
| 4,400,419 | A | | 8/1983 | Laczynski | |
| 4,860,476 | A | * | 8/1989 | Hall | 40/593 |
| 5,339,551 | A | | 8/1994 | Elmer | |
| 5,396,408 | A | | 3/1995 | Szczech, III | |
| 5,430,965 | A | | 7/1995 | Lai | |
| 5,692,826 | A | | 12/1997 | Hsien-Jung | |
| 5,729,924 | A | * | 3/1998 | Reading | 40/564 |
| 6,446,375 | B1 | | 9/2002 | Davis | |
| 6,449,889 | B1 | | 9/2002 | Hottenstein | |
| 6,732,460 | B2 | * | 5/2004 | Blakeslee | 40/564 |
| 2002/0139024 | A1 | | 10/2002 | Applebee | |
| 2003/0079392 | A1 | | 5/2003 | Newman | |

* cited by examiner

*Primary Examiner*—Andrew D. Wright
(74) *Attorney, Agent, or Firm*—Richard C. Litman

(57) ABSTRACT

An illuminated flag decal attached to a base surface. The illuminated flag decal has a generally rectangular frame with a front face and a back face, a plurality of suction cups that will secure the generally rectangular frame to the base surface, an image of a flag that is placed in the generally rectangular frame, an illumination source to cast light onto the image of the flag, a power source to provide power to the illumination source and a removable backing on the rear face of the generally rectangular frame for gaining access to and changing the illumination source.

8 Claims, 4 Drawing Sheets

ILLUMINATED FLAG DECAL

BACKGROUND OF THE INVENTION

1. Field of the Invention

The present invention relates to flags in general, and more specifically to an illuminated flag decal.

2. Description of the Related Art

There are many devices that can be used to show and hold decals. Some of these devices are illuminated for added visibility and effect. Many of these decals are related to sports teams, slogans, logos and even flags. The related art reflects some of these devices and decals.

U.S. Patent Application Publication Number 2003/0079392 published on May 1, 2003, outlines the use of a small transparent plastics decal holder. The decal holder is made special because it has the ability to be placed on an automobile window using suction cups. The decal holder is made in such a way to allow a decal to be placed between the front and the back of the two surfaces.

U.S. Patent Application Publication Number 2002/0139024 published on Oct. 3, 2002, outlines the use of a device for displaying messages, including bumper stickers. The invention includes means of adjusting the horizontal length to allow insertion therein of messages of varying lengths. The invention also includes means of removably attaching the device to other surface, such as the windows of cars. The invention is also constructed such that the upper end is open allowing protrusion therethrough of messages of varying heights.

U.S. Pat. No. 3,004,359 issued to Pisciotta on Oct. 17, 1961, outlines the use of an illuminated window sign designed particularly for installation in the window of an automobile.

U.S. Pat. No. 4,400,419 issued to Laczynski on Aug. 23, 1983, outlines the use of a decal assembly of the type having a translucent sheet with indicia thereon and having an adhesive on the back thereof protected by a backing sheet, and a separate blank clear translucent sheet having adhesive on one side and a backing thereover.

U.S. Pat. No. 5,339,551 issued to Elmer on Aug. 23, 1994, outlines the use of a rigid aerodynamic advertising member that is removably mounted to either the tailgate or vertical side of the bed of a pick-up truck with a mounting bracket coupled to rigid braces attached to the advertising member, with the dimensions between the braces being sufficient to insure rigidity while the truck is underway.

U.S. Pat. No. 5,396,408 issued to Szczech, III on Mar. 7, 1995, outlines the use of a detachable window ornament that includes a plurality of light sources inside a plenum formed from an opaque rear wall, a continuous side wall extending about it, and a front, translucent panel. Attached to the side walls are a number of suction cups that allow the device to be removably attached to the window. The front panel can carry a variety of different ornamental displays, such as those relating to a specific holiday or the like.

U.S. Pat. No. 5,430,965 issued to Lai on Jul. 11, 1995, outlines the use of a message display board which includes a writing board embedded on a base plate mounted on a fixed object such as a car. There is also a pen clamped on a pen-holding portion formed on the base plate for writing purposes, a plurality of suction cups which are attached by vacuum on a wall such as a windshield of a car, to present the writing board outwardly to display messages written on the writing board and a lamp secured on the base plate for illuminating the writing board to be visible at nighttime or in a dark place.

U.S. Pat. No. 5,692,826 issued to Hsien-Jung on Dec. 2, 1997, outlines the use of a neon light assembly which includes a base provided with a switch and a first electrical socket on its vertical wall and a second electrical socket on its center and a transparent casing provided with a first electrical plug engageable with the second electrical socket of the base, and a neon light fitted within the transparent casing that is electrically connected with the electrical plug.

U.S. Pat. No. 6,446,375 issued to Davis on Sep. 10, 2002, outlines the use of a durable lightweight rigid transparent envelope that is slightly curved in shape from top to bottom and attaches to automobile windows via suction cups in order to hold and display a variety of double-sided thin flexible lightweight message sheets, which are highly color-contrasted, light-reflective and contain large font character size messages in order to facilitate visual communication between automobile operators, passengers and pedestrians at distances normally encountered on streets and highways.

U.S. Pat. No. 6,449,889 issued to Hottenstein on Sep. 17, 2002, outlines the use of a lighted display device for use with a vehicle that includes a pair of transparent spaced apart panes held by a frame member having opposed side walls and a bottom wall. The upper edges of the panes define an opening for the insertion or removal of a sign member having indicia indicative of the experience level or age of a driver or other message.

United Kingdom Patent Number 2,183,383 granted to Scott et al. on Jun. 3, 1987, outlines the use of a vehicle-located flashing advertising sign, using fluorescent light sources, for use by motor vehicle dealers, located above the dashboard so as to be visible through the windshield and would normally be used to advertise the vehicle for sale.

Although each of the inventions outlined are novel and useful, what is really needed is an illuminated flag novelty that can be placed in an automobile or at home. With all of the patriotism being shown since the Sep. $11^{th}$ attacks, such a novelty would be very much in demand in the marketplace.

None of the above inventions and patents, taken either singly or in combination, is seen to describe the instant invention as claimed. Thus an illuminated flag decal solving the aforementioned problems is desired.

SUMMARY OF THE INVENTION

The invention is an illuminated flag decal attached to a base surface. The illuminated flag decal has a generally rectangular frame with a front face and a back face, a plurality of suction cups that will secure the generally rectangular frame to the base surface, an image of a flag that is placed in the generally rectangular frame, an illumination source to cast light onto the image of the flag, a power source to provide power to the illumination source and a removable backing on the rear face of the generally rectangular frame for gaining access to and changing the illumination source.

Accordingly, it is a principal object of the invention to provide a novelty item in the form of a flag.

It is another object of the invention to provide a novelty item in the form of a flag that is illuminated.

It is a further object of the invention to provide a novelty item in the form of a flag that can be attached to the inside window of an automobile.

Still another object of the invention is to provide a novelty item in the form of a flag that can be used for home, work or business.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
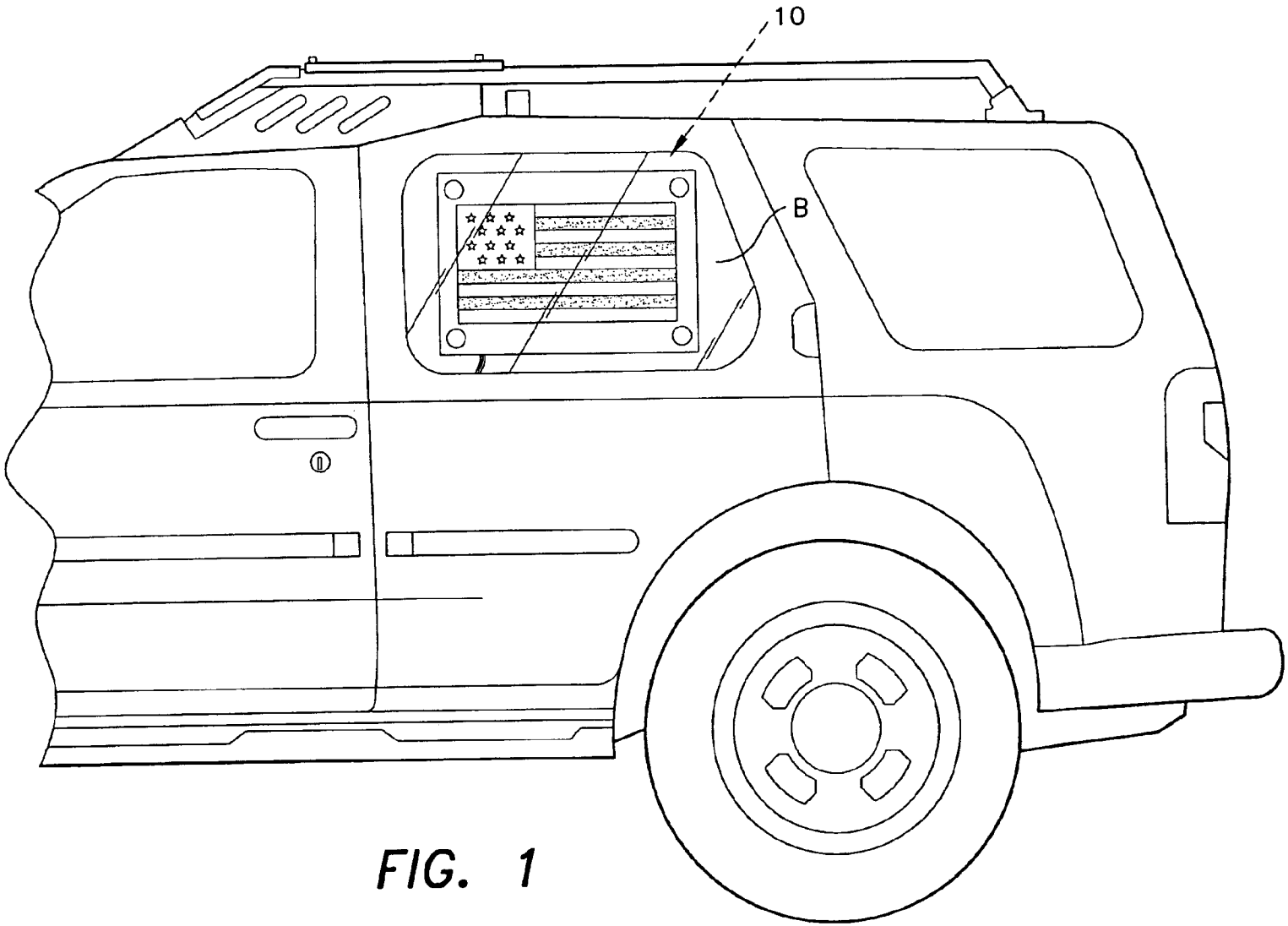
FIG. 1 is an environmental, perspective view of an illuminated flag decal according to the present invention.

The present invention is an illuminated flag decal 10 attached to a base surface B, as is shown in FIG. 1.

Figure 2:
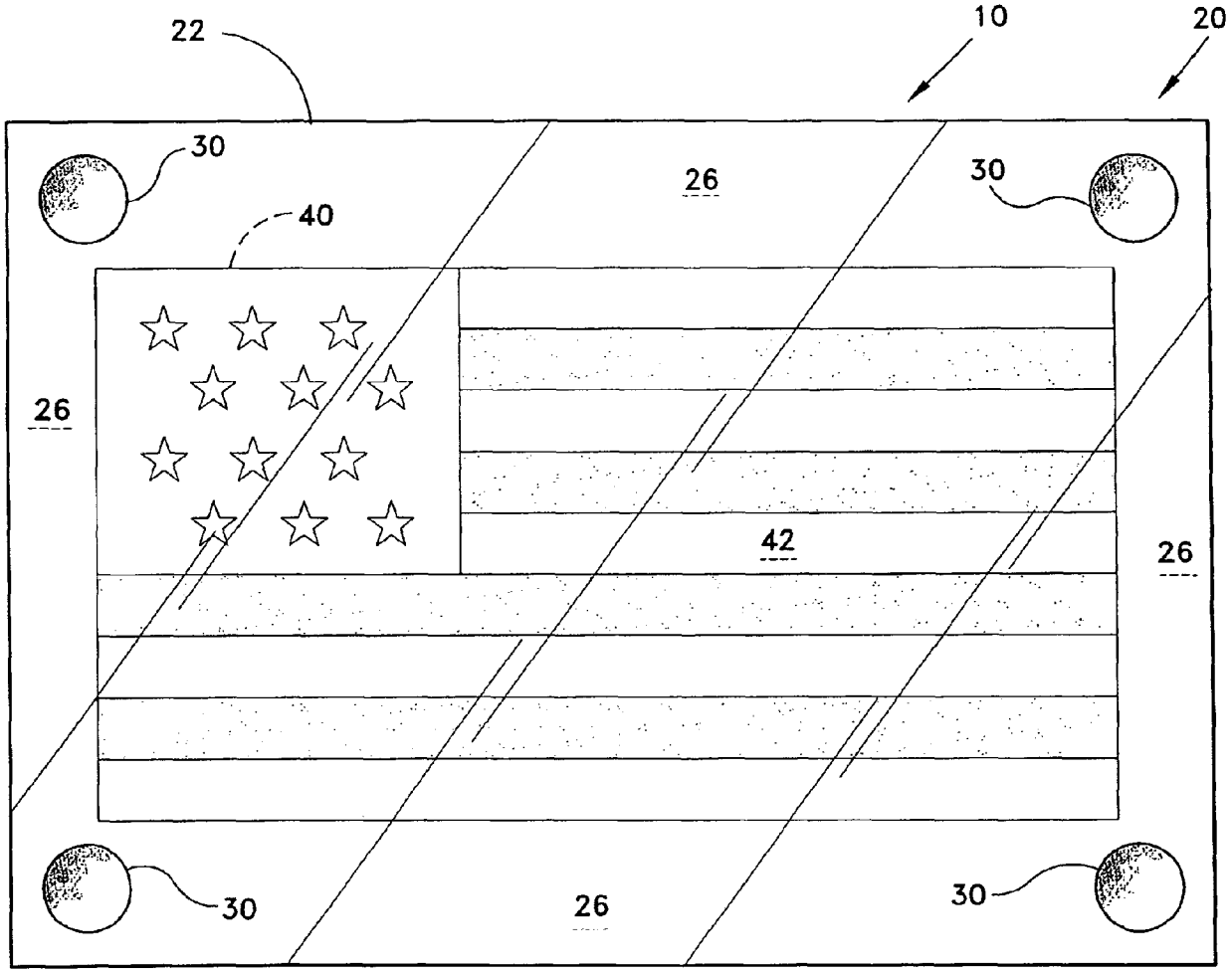
FIG. 2 is a front perspective view of an illuminated flag decal.

The illuminated flag decal 10 comprises a generally rectangular frame 20 with a front face 22 and a back face (FIG. 4, 24), a plurality of suction cups 30 that will secure the generally rectangular frame 20 to the base surface B and an image of a flag 40 that is placed in the generally rectangular frame 20, adjacent an interior surface of the front face 22, as is depicted in FIG. 2. The illuminated flag decal 10 is typically shown from inside a vehicle with the front face 22 facing outward for persons to see or view through the base surface B, which is usually the inside of a glass window. There is a border 26 around the image of a flag 40 where the plurality of suction cups 30 are placed on the exterior of the front face 22, so that suction cups 30 do not block or interfere with the viewing of the image of the flag 40. The front face 22, or at least the center section 42 of the front face 22 is made of a continuous transparent material, such as glass or plastic, so that viewers see an unobstructed image of the flag 40.

Figure 3:
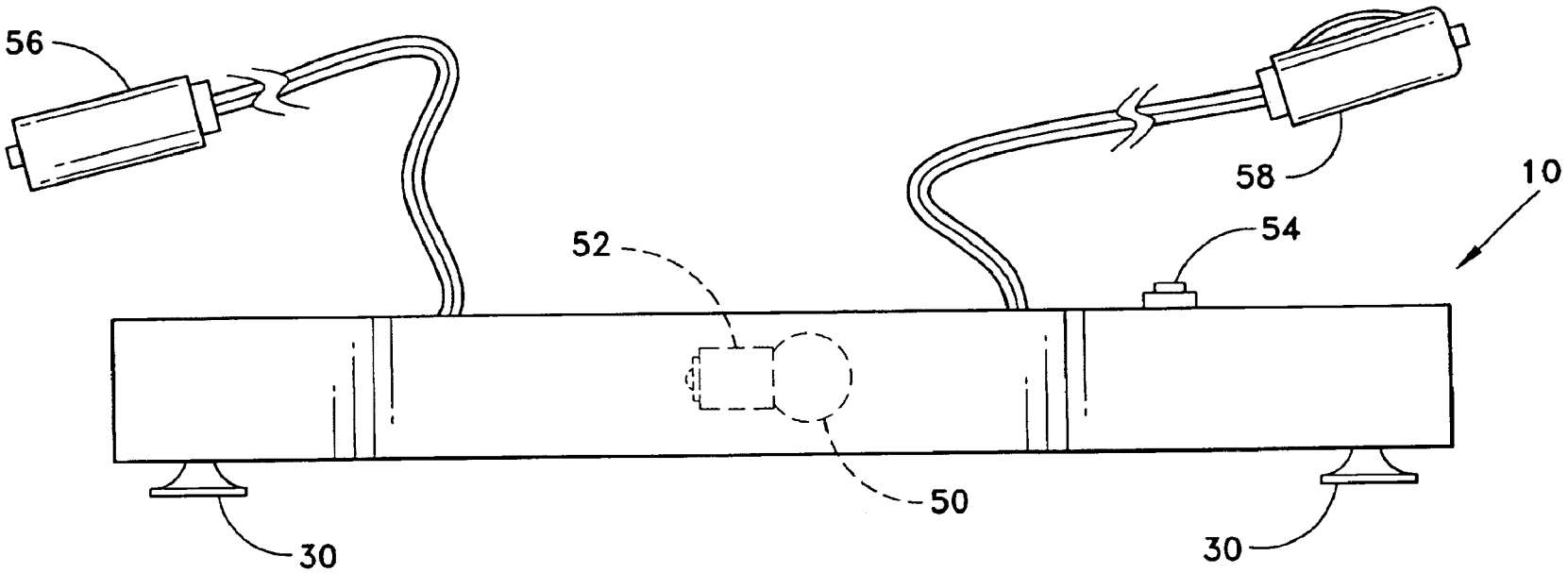
FIG. 3 is an overhead perspective view of an illuminated flag decal.

FIG. 3 depicts an illumination source to cast light onto the. image of the flag 40. The illuminated flag decal 10 can have several possible illumination sources, the first of which is an ordinary light bulb 50 and light socket 52 arrangement. Another possible illumination source can also include a florescent light bulb and light socket (not shown) and the illumination source can also be tied into and synchronized with a vehicle's headlights, taillights or brake lights (not shown) for a illuminated flag decal 10 used in an vehicle for added effect. There is also an activation switch 54 for turning the illuminated flag decal 10 on and off, as well as a cord for an AC electrical plug 56 and a DC electrical plug 58.

Figure 4:
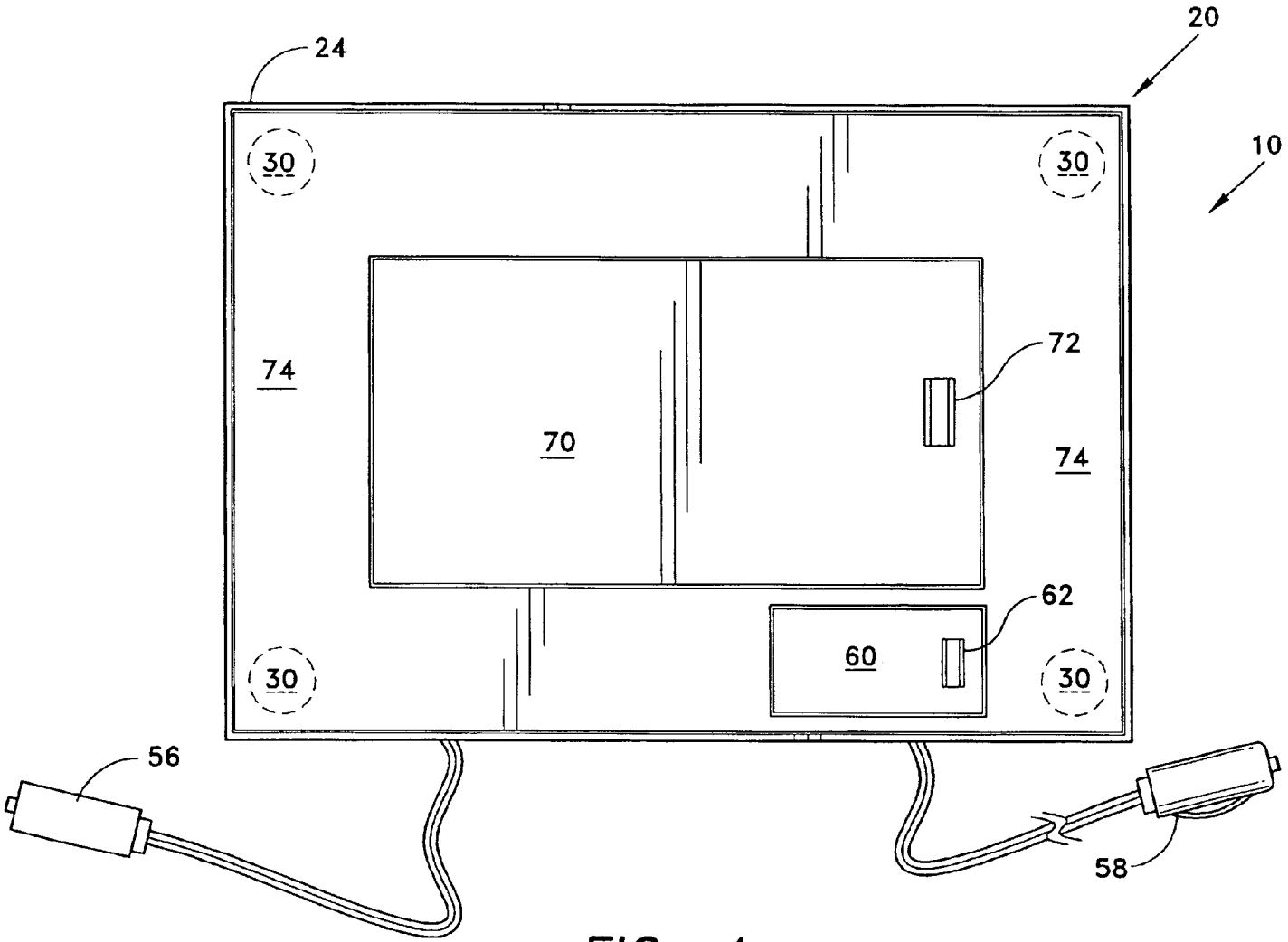
FIG. 4 is a rear perspective view of an illuminated flag decal.

FIG. 4 depicts the back face 24 of the illuminated flag decal 10. The back face 24 of the illuminated flag decal 10 usually faces the backside of the interior of a vehicle that could utilize the illuminated flag decal 10. The back face 24 does not have any areas of transparency such as the front face 22 and center section 42. The illuminated flag decal 10 can utilize a number of different types of power sources. The illuminated flag decal's 10 power sources vary depending on the location of the illuminated flag decal 10. The illuminated flag decal 10 can include an electrical outlet (not shown), primarily used when the illuminated flag decal 10 is located away from a vehicle and is situated in a home or office. When the illuminated flag decal 10 is situated within a vehicle, the power source is typically a cigarette lighter of a vehicle. Most vehicles utilize a 12 V battery through the cigarette lighter, which is more than enough to keep the illuminated flag decal 10 illuminated. A battery pack 60 can also be used to provide a user with a power source that is more mobile.

FIG. 4 also depicts a removable backing 70 on the back face 24 of the generally rectangular frame 20 for gaining access to and changing the illumination source, as well as a border 74 around the removable backing 70. There is a recessed tab 72 on the removable backing 70 so that a user can pinch the recessed tab 72 to pick out the removable backing 70. Similarly, there is also a second removable backing for the battery pack 60 and a second recessed tab 62 for easy removal and extraction.

Use of the illuminated flag decal 10 is straightforward. The illuminated flag decal 10 is manually placed on a particular base surface B, which many times is the inside window of a vehicle. The size of the vehicle model of the illuminated flag decal 10 is 4"×7.5"×1.25", with the image of the American flag 40 being 3"×5". There is also a home and business model of the illuminated flag decal 10 which is 18"×18"×4", with the image of the American flag 40 being 11.5"×7". Battery pack 60 and removable backing 70 are also handled manually as well as the use of the AC electrical plug 56 and the DC electrical plug 58. The illuminated flag decal 10 can also be used for other flags from other nations and states.

It is to be understood that the present invention is not limited to the embodiments described above, but encompasses any and all embodiments within the scope of the following claims.

I claim:

1. An illuminated display box, comprising:

a generally rectangular frame having a continuous transparent front face, and an opaque back face, said frame defining an exterior and an interior;

wherein said interior is bounded by said frame around a perimeter, said front face and said back face;

said continuous transparent front face defining an unimpeded visual area and a bordering perimeter;

a plurality of suction cups for securing the generally rectangular frame to supporting surface;

said plurality of suction cups being mounted in predetermined arrangement about the bordering perimeter of the exterior of said front face;

said back face includes a removable backing for accessing the interior of the frame;

at least one translucent flag removably disposed on the interior of the unimpeded visual area of the front face; and an illumination source mounted on the interior of the frame between said front face and said back face, said illumination source illuminating said at least one translucent flag;

said illumination source including a power source.

2. The illuminated display box according to claim 1, wherein the illumination source is an incandescent lighting source.

3. The illuminated display box according to claim 1, wherein the illumination source is a florescent lighting source.

4. The illuminated display box according to claim 1, wherein the power source further comprises:

a battery compartment disposed within the interior of the frame; and said removable backing includes at least one access passage for accessing said battery compartment.

5. The illuminated display box according to claim 4, wherein the power source is a battery.

6. The illuminated display box according to claim 1, wherein the power source is an electrical cord for connecting to an electrical supply.

7. The illuminated display box according to claim 6, wherein the electric cord includes a DC adapter for connecting to a power outlet of a vehicle.

8. The illuminated display box according to claim 6, wherein the electric cord includes an AC adapter for connecting to a power outlet of an alternating power supply.

* * * * *